United States Patent [19]

Moss et al.

[11] 3,955,393

[45] May 11, 1976

[54] WIRE DRAWING MACHINE FOR IN-LINE OPERATION

[75] Inventors: James Moss, Liverpool; David Dutton, Appleton near Warrington, both of England

[73] Assignee: British Insulated Callender's Cables Limited, London, England

[22] Filed: Nov. 12, 1974

[21] Appl. No.: 523,154

[30] Foreign Application Priority Data

Nov. 16, 1973 United Kingdom ..... 53461/73

[52] U.S. Cl. ..... 72/279; 72/278; 72/289

[51] Int. Cl.[2] ..... B21C 1/04

[58] Field of Search ..... 72/278, 279, 280, 281, 72/288, 289, 443

[56] References Cited

UNITED STATES PATENTS

| | | | |
|---|---|---|---|
| 643,854 | 2/1900 | Baldwin | 72/289 |
| 805,265 | 11/1905 | Cowles et al. | 72/289 |
| 3,810,380 | 5/1974 | Newberry et al. | 72/289 |
| 3,811,312 | 5/1974 | Pietroni | 72/289 |
| 3,842,643 | 10/1974 | Large | 72/289 |

*Primary Examiner*—Lowell A. Larson
*Attorney, Agent, or Firm*—Buell, Blenko, & Ziesenheim

[57] ABSTRACT

A wire-drawing machine, suitable for use in-line with an enamelling machine, comprises a plurality of individual wire-drawing capstans mounted in individual bearings, at least one for each capstan. The capstans are arranged in a substantially planar rectangular array (comprising rows and columns of the capstans) with their axes aligned with the rows thereof. A series of parallel drive shafts, each serve all the capstans of one row or one column of the array. The capstans of one column are associated with a single wire line whereas the capstans of any one row are associated with a corresponding drawing stage for all the wires lines.

8 Claims, 4 Drawing Figures

WIRE DRAWING MACHINE FOR IN-LINE OPERATION

In the Complete Specification of British Pat. No. 1305032 (which corresponds in part to U.S. Pat. No. 3,842,643 issued on Oct. 22, 1974 to Large Moss and Dutton) the Assignee of this Application is described and claimed (inter alia) apparatus for manufacturing drawn and further processed (especially enamelled) wire comprising:

a. for each of two (and usually considerably more than two) wires drawing means including at least one capstan and at least two dies capable of drawing the respective wires to a total reduction in area of at least 30%;

b. a common source for driving all the drawing capstans; and c. subsequent processing apparatus to which all the wires can be passed directly (i.e. without first passing through an accumulator) from the drawing means including means determining the speed of the wires, during drawing as well as during the subsequent processing, at such a value that the speed of each wire through each die through which it passes is so related to the reduction in cross-section to be effected at that die that the wire will not be heated to the extent that the properties of the drawn wire will be affected by the temperature rise.

The present invention relates to wire-drawing machines that are especially, though not exclusively, suitable for use inline with an enamelling machine in apparatus of the kind described.

In the wire-drawing machine in accordance with the invention, a plurality of individual wire-drawing capstans are mounted in individual bearings, at least one for each capstan, arranged in a substantially planar rectangular array (comprising rows and columns of the capstans) with their axes aligned with the rows thereof and are driven by a series of parallel drive shafts each serving either all the capstans of one column or preferably all of the capstans of one row of the array. The capstans of any one column are associated with a single wire line whereas the capstans of any one row are associated with a corresponding drawing stage for all the wire lines.

The principal advantage of driving the capstans of a wire drawing stage from a common shaft is that both the capstans themselves and the gearing coupling them to the shafts may be identical throughout the machine, the necessary differences in peripheral speeds ('capstan elongations') being obtained by driving the shafts at different speeds. Preferably the number of wire drawing stages (rows in the array) and the number of wire lines (columns) are each at least four.

Preferably means are provided for stopping an individual wire line, in case of wire breakage for example. In a machine with shafts driving individual wire lines, it would be appropriate to stop the corresponding shaft, using a single clutch if a common motor is used for all the shafts, but in machines with shafts driving the corresponding stage of different wire lines individual clutches will be required for all the capstans; since however, the shafts will in this case be parallel to the capstan axes a simple arrangement in which an idler wheel mounted on a lever may be engaged with the capstan and its drive shaft or withdrawn from engagement with at least one of them may be adopted.

The invention will be further described, by way of example, with reference to the accompanying drawings in which.

Figure 1:
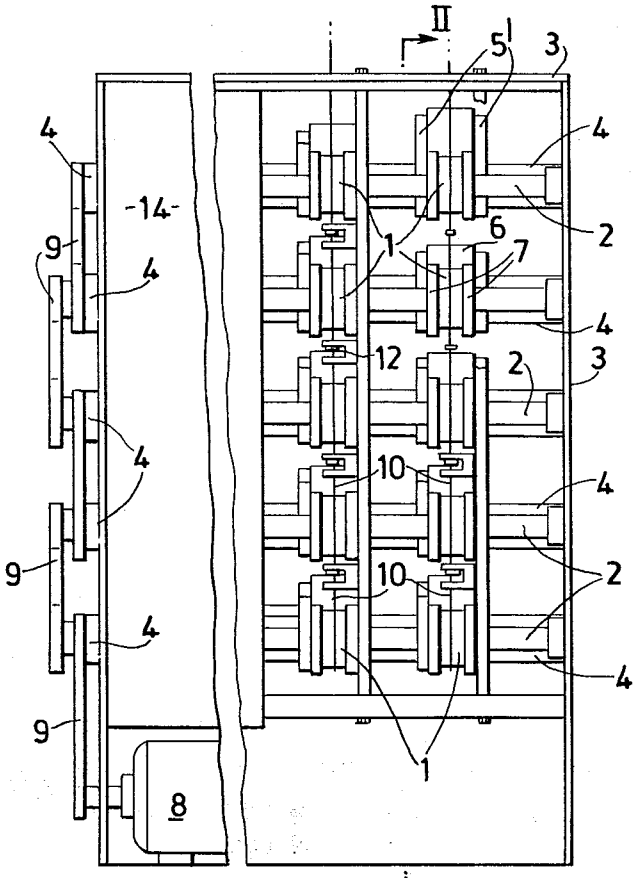
FIG. 1 is a diagram of the front elevation of a first form of machine in accordance with the invention.

In the machine of FIG. 1, individual capstans 1 are mounted rotatably on non-rotating horizontal support rods 2, mounted in a vertical plane in a suitable frame 3. Capstans for any one drawing stage are located on the same rod, whereas all the capstans for any one wire line are vertically aligned, forming a rectangular array in which each row corresponds to a particular drawing stage and each column to a particular wire line. The number of rows and columns is in no way critical, though there will not usually be less than four of each: it will often be desirable to have from five to eight rows (stages) and from eight to about eighteen columns (lines).

Figure 2:
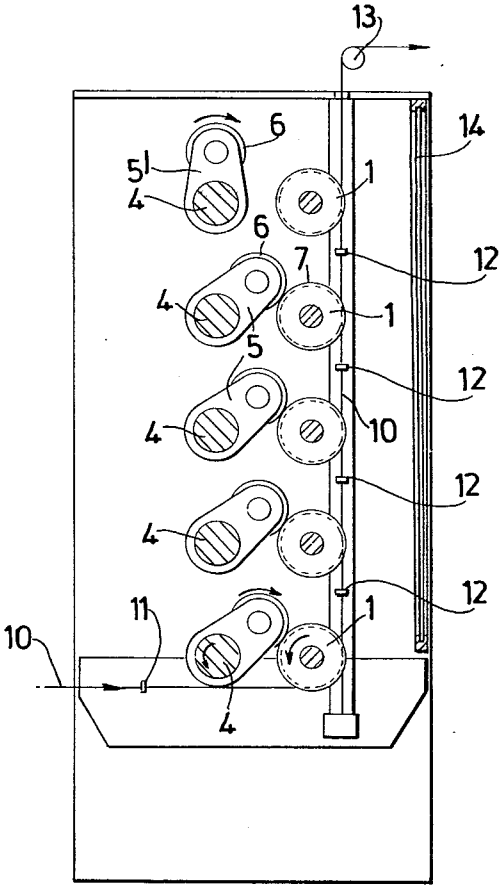
FIG. 2 is a diagramatic cross-section on the line II, II in FIG. 1.

Mounted behind and parallel to each of the rods 2 is a driven shaft 4, and all of these rods rotate in the same direction (anticlockwise as seen in FIG. 2). ASsociated with each of the capstans 1 is a lever 5, rotatably mounted on the respective shaft 4 and bearing an idler roll 6 which engages the surface of and is driven by the shaft. The lever 5 may be moved from a working position in which the roll 6 also engages the rims 7 of the capstan 1, so driving the capstan, and a disengaged position as shown at 5' (FIG. 2).

The shafts 4 may be driven in various ways. For the purpose of illustration a single motor 8 is shown driving all the shafts 4 through a series of belts 9. These belts may all be located at the same end of the machine, as shown, or they may be located alternately at the two ends, the latter arrangement having the advantage of improved accessibility. Toothed (timing) belts are preferred. It is useful to tension each belt by an adjustable tensioning wheel, so that the drive ratio can be reset, if required (to accomodate a different die set and/or wire size) by changing one component only for each stage (either the wheel that drives the shaft, or the wheel that the shaft drives). One possible variation is to have variable-ratio gearing between shafts, especially for driving the shaft for the last drawing stage, which permits small adjustments of die size to be made without stripping down the machine. Another, related, variation uses a separate motor to drive the shaft for the last drawing stage; either a variable-speed motor can be used, or a constant-speed motor driving through variable-speed gearing. Yet another possibility is to drive all the shafts 4 by individual motors, with or without variable-speed gearing.

The wire 10 enters horizontally at the rear of the machine and passes through a first drawing die 11 onto the lowest of the capstans 1; it then passes upwardly through the remaining dies 12 and round the respective capstans, finally leaving the drawing machine over a pulley 13 from which it passes (for example) to enamelling plant or to a take-up mechanism. Glass doors 14 can be fitted to minimise risk of foreign particles entering the drawing dies.

The machine of FIGS. 3 and 4 has the same basic layout, and only the parts that differ from FIGS. 1 and 2 will be described.

In this case vertical drive shafts 15 are used, each serving all the capstans of one wire line. Each capstan is driven via a mitre drive 16, belt 17 and pulley 18. The required capstan elongation is obtained by using mitre drives of appropriate different ratio for the various stages. The main advantage of this machine is that it is possible to stop the rotation of individual shafts 15 independently of the others, as for instance when one wire breaks and has to be re-threaded; for this purpose each shaft is driven either by a separate motor 19 (as illustrated) or through a clutch from a common motor. Variable speed gearing cannot be used to vary the capstan elongation of this machine, but it can be used (as can variable speed motors) simply to adjust the wire speed.

Figure 4:
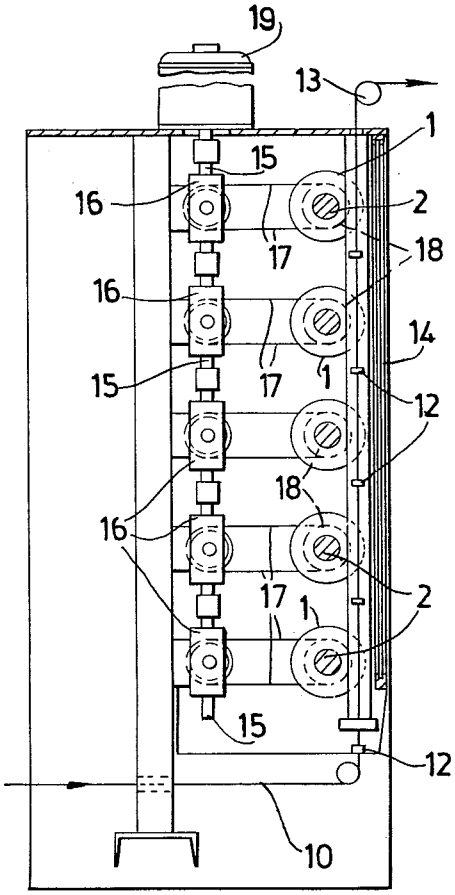
FIGS. 3 and 4 are views, corresponding to FIGS. 1 and 2 respectively, of a second form of machine in accordance with the invention.
Figure 3:
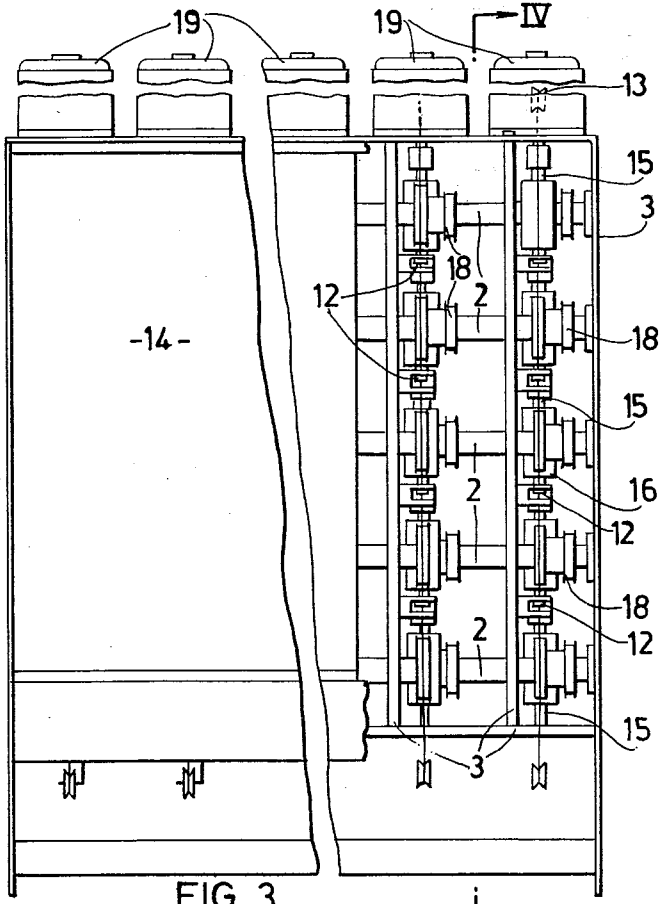

The principal advantage of the machine shown in FIGS. 1 and 2 over that shown in FIGS. 3 and 4 is that the capstan elongation can be much more readily varied; a further advantage is that the gearing elements driving the capstans from the shafts are very simple and are identical for all the capstans.

What we claim as our invention is:

1. A wire-drawing machine, suitable for use in-line with an enamelling machine, comprising a plurality of individual wire-drawing capstans mounted for rotation about respective axes in individual bearings, at least one for each capstan, arranged in a substantially planar rectangular array (comprising rows and columns of the capstans) with their said axes aligned with the rows thereof and driven by a series of parallel drive shafts, each serving all the capstans of one row of the array but separate from those capstans, said capstans of one said column being associated with a single one of a plurality of wire lines whereas said capstans of any one row are associated with a corresponding drawing stage for all said wires lines.

2. A wire-drawing machine as claimed in claim 1 wherein said capstans are driven through identical individual gearing by said drive shafts which are themselves driven at different speeds.

3. A wire-drawing machine as claimed in claim 1 including an individual clutch between each capstan and its shaft.

4. A wire-drawing machine as claimed in claim 3 in which said individual clutch comprises an idler wheel mounted on a lever which wheel may optionally be engaged with the capstan and its drive shaft and may alternatively be withdrawn from engagement with at least one of them.

5. A wire-drawing machine as claimed in claim 1 in which the number of said rows and the number of said columns are each at least four.

6. A wire-drawing machine, suitable for use in-line with an enamelling machine, comprising a plurality of individual wire-drawing capstans mounted for rotation about respective axes in individual bearings, at least one for each capstan, arranged in a substantially planar rectangular array (comprising rows and columns of the capstans) with their said axes aligned with the rows thereof and driven by a series of parallel drive shafts, each serving all the capstans of one column of the array, said capstans of one column being associated with a single one of a plurality of wire lines whereas said capstans of any one row are associated with a corresponding drawing stage for all said wires lines.

7. A wire-drawing machine as claimed in claim 6 including a common motor for driving all said shafts and a separate clutch for stopping the motion of each said drive shaft.

8. A wire-drawing machine as claimed in claim 6 in which the number of said rows and the number of said columns are each at least four.

* * * * *